US011440017B2

(12) United States Patent
Lönngren

(10) Patent No.: US 11,440,017 B2
(45) Date of Patent: Sep. 13, 2022

(54) STEAM EVACUATION IN A PULP OR FIBER REFINER

(71) Applicant: Valmet AB, Sundsvall (SE)

(72) Inventor: Karl Lönngren, Stockholm (SE)

(73) Assignee: Valmet AB

( * ) Notice: Subject to any disclaimer, the term of this patent is extended or adjusted under 35 U.S.C. 154(b) by 406 days.

(21) Appl. No.: 16/489,865

(22) PCT Filed: Feb. 8, 2018

(86) PCT No.: PCT/SE2018/050116

§ 371 (c)(1),
(2) Date: Aug. 29, 2019

(87) PCT Pub. No.: WO2018/160115

PCT Pub. Date: Sep. 7, 2018

(65) Prior Publication Data

US 2019/0388899 A1 Dec. 26, 2019

(30) Foreign Application Priority Data

Mar. 3, 2017 (SE) ..... 1750234-5

(51) Int. Cl.
*B02C 7/12* (2006.01)
*B02C 7/06* (2006.01)
(Continued)

(52) U.S. Cl.
CPC ..... *B02C 7/12* (2013.01); *B02C 7/06* (2013.01); *D21B 1/22* (2013.01); *D21D 1/008* (2013.01); *D21B 1/26* (2013.01); *D21D 1/306* (2013.01)

(58) Field of Classification Search
CPC ..... B02C 7/02–08; B02C 7/12; B02C 7/14; B02C 23/02; D21D 1/22; D21D 1/006;
(Continued)

(56) References Cited

U.S. PATENT DOCUMENTS 4,221,631 A * 9/1980 Hellerqvist ..... D21D 1/30 162/28
2007/0164143 A1 7/2007 Sabourin et al.
(Continued)

FOREIGN PATENT DOCUMENTS

WO 9635016 A1 11/1996

OTHER PUBLICATIONS

International Search Report including the Written Opinion from Application No. PCT/SE2018/050116 dated Apr. 11, 2018, 10 pages.

*Primary Examiner* — Jessica Cahill
*Assistant Examiner* — Smith Oberto Bapthelus
(74) *Attorney, Agent, or Firm* — Lerner, David, Littenberg, Krumholz & Mentlik, LLP

(57) ABSTRACT

A refining disc (6) in a defibrator (1) for refining fibrous material is provided with non-central openings (11) for allowing steam developed in the refining space (2) during refining to flow from the front side to the backside of the refining disc (6), where the front side is facing a second refining disc (5) and the backside is facing away from the second refining disc (5). The refining disc (6) also comprises a central hole (12) for allowing steam (8*b*) to flow from the backside to the front side at the rotational center of the refining disc (6), and escape from the defibrator (1) backwards through the feed screw (3*a*) without passing through the fibrous material (7) being refined in the refining space (2).

4 Claims, 4 Drawing Sheets

(51) Int. Cl.

| | |
|---|---|
| ***D21B 1/22*** | (2006.01) |
| ***D21D 1/00*** | (2006.01) |
| ***D21B 1/26*** | (2006.01) |
| ***D21D 1/30*** | (2006.01) |

(58) Field of Classification Search
CPC ..... D21D 1/008; D21D 1/26; D21D 1/30; D21D 1/303; D21D 1/306
USPC ..... 241/246, 257.1, 259, 261.2, 261.3, 74
See application file for complete search history.

(56) References Cited

U.S. PATENT DOCUMENTS

| | | | | |
|---|---|---|---|---|
| 2011/0089273 | A1* | 4/2011 | Lindroos ..... | D21D 1/22 241/291 |
| 2012/0018549 | A1 | 1/2012 | Gingras | |
| 2015/0306603 | A1* | 10/2015 | Wu ..... | D21D 1/30 241/245 |
| 2016/0023216 | A1 | 1/2016 | Lonngren | |

* cited by examiner

STEAM EVACUATION IN A PULP OR FIBER REFINER

CROSS-REFERENCE TO RELATED PATENT APPLICATIONS

The present application is a national phase entry under 35 U.S.C. § 371 of International Application No. PCT/SE2018/050116 filed Feb. 8, 2018, published in English, which claims priority from Swedish Application No. 1750234-5 filed Mar. 3, 2017, all of which are incorporated herein by reference.

TECHNICAL FIELD

The present invention generally relates to refining of fibrous material in a pulp or fiber refiner, and more particularly to evacuation of steam developed during the refining process.

BACKGROUND

A defibrator is a thermomechanical pulping refiner in which the pulp material, such as wood chips or other lignocellulose-containing fibrous material, is ground in an environment of steam between two refining discs, a rotating grinding disc (rotor) opposing a stationary disc (stator), or alternatively, two rotating discs opposing one another, to produce wood fibers. The refining discs are aligned along a pulp feeding axis and the rotating disc is arranged on a rotatable axis that can be rotated relative to the other disc by means of e.g. an electrical motor. The inner surfaces, i.e. the surfaces opposing one another, of the refining discs are typically provided with one or more refining segments having refining bars and grooves of different sizes and orientations, for improving the grinding action on the fibers. A refining space is defined between the inner (refining) surfaces of the refining segments, which are typically located near the circumference of the refining discs. Wood chips or similar fibrous material is fed via a feeding channel along the pulp feeding axis through a hole in one of the discs, usually the stator, and into a central space between the discs. Wood chips fed into the center of the refining discs are pushed by the centrifugal force towards the circumference of the discs to emerge in the refining space between the refining surfaces of the refining segments, where the refining/grinding of the fibrous material is performed. The bars and grooves of the refining segments are usually finer nearer the circumference of the discs. The size of the refined fibers can to some extent be controlled by altering the distance between the discs and thus the refining surfaces where a closer distance produces finer fibers but also requires higher grinding force.

Generally, the lignocellulose-containing material contains water as the wood chips are usually steamed with hot water and/or steam before being introduced into the defibrator. Further, water may be supplied in connection with the refining. From this water, a great amount of steam is generated in the refining space during the refining operation of the fibrous material, since the grinding of the material requires a lot of energy due to the extensive friction and generates a lot of heat which evaporates the water. The generated steam may pass out of the refining space together with the refined material, and may also flow backwards towards the location where the incoming chips are fed into the defibrator. The steam flow through the refining space assumes a very high speed and can negatively affect the flow of fibrous material and also increase the energy consumption of the refiner. The steam may also flow in an irregular manner and thereby affect the stability of the refining gap, rendering the material flow through the gap non-uniform. This has a negative effect on the pulp quality. Therefore, it is important to minimize the disturbance from the steam developed during the refining process.

Previous efforts to alleviate the problems associated with the generation of steam between the refining discs have involved withdrawing steam from the central space between the refining discs. For example, U.S. Pat. No. 4,221,631 A shows a disc refiner comprising a pair of refining discs each of which has an inner refining surface. The refining surfaces are opposing each other during relative rotation of the discs and define a refining space between them. The refining segments are provided with passageways extending through the segments from the refining space to the rear surface of the segments for removing steam developed in the refining space and releasing it into the refining housing.

However, there is continued need in the art to further improve the evacuation of steam from the refining space of the refiner.

SUMMARY

It is an object to provide a refining disc which further improves the evacuation of steam developed during the refining process.

This and other objects are met by embodiments of the proposed technology.

According to a first aspect, there is provided a first refining disc in a defibrator for refining fibrous material, where the first refining disc comprises a refining surface adapted to face a refining surface of a second refining disc, so that the refining surfaces define a refining space between them and are adapted to refine the fibrous material. The first refining disc is provided with at least one non-central opening extending from a front side of the first refining disc to a backside of the first refining disc, where the front side is adapted to face the second refining disc and the backside is adapted to face away from the second refining disc, for allowing steam developed in the refining space during refining to flow through the at least one non-central opening from the front side to the backside of the first refining disc. The first refining disc also comprises a central hole located in a rotational center of the first refining disc and extending from the backside to the front side of the first refining disc, for allowing steam to flow through the central hole from the backside to the front side of the first refining disc at the rotational center of the first refining disc.

According to a second aspect, there is provided a defibrator for refining fibrous material, comprising a first refining disc according to the above.

By guiding the steam to the backside of the refining disc and then backwards out of the defibrator through the middle of the refining disc according to the present invention, thereby facilitating evacuation of steam from the defibrator without disturbing the chip feed, at least the following advantages can be achieved:

- Less turbulence and losses, resulting in better and more stable feed of wood chips
- Less micro-pulsation
- Less build-ups of fiber in the center plate and ribbon feeder In turn, the above leads to lower specific energy consumption (SEC), more uniform fiber quality and longer segment lifetimes.

Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference designations are used for similar or corresponding elements.

As described in the background section there is continued need in the art to further improve the evacuation of steam from the refining area of the refiner.

Figure 1:
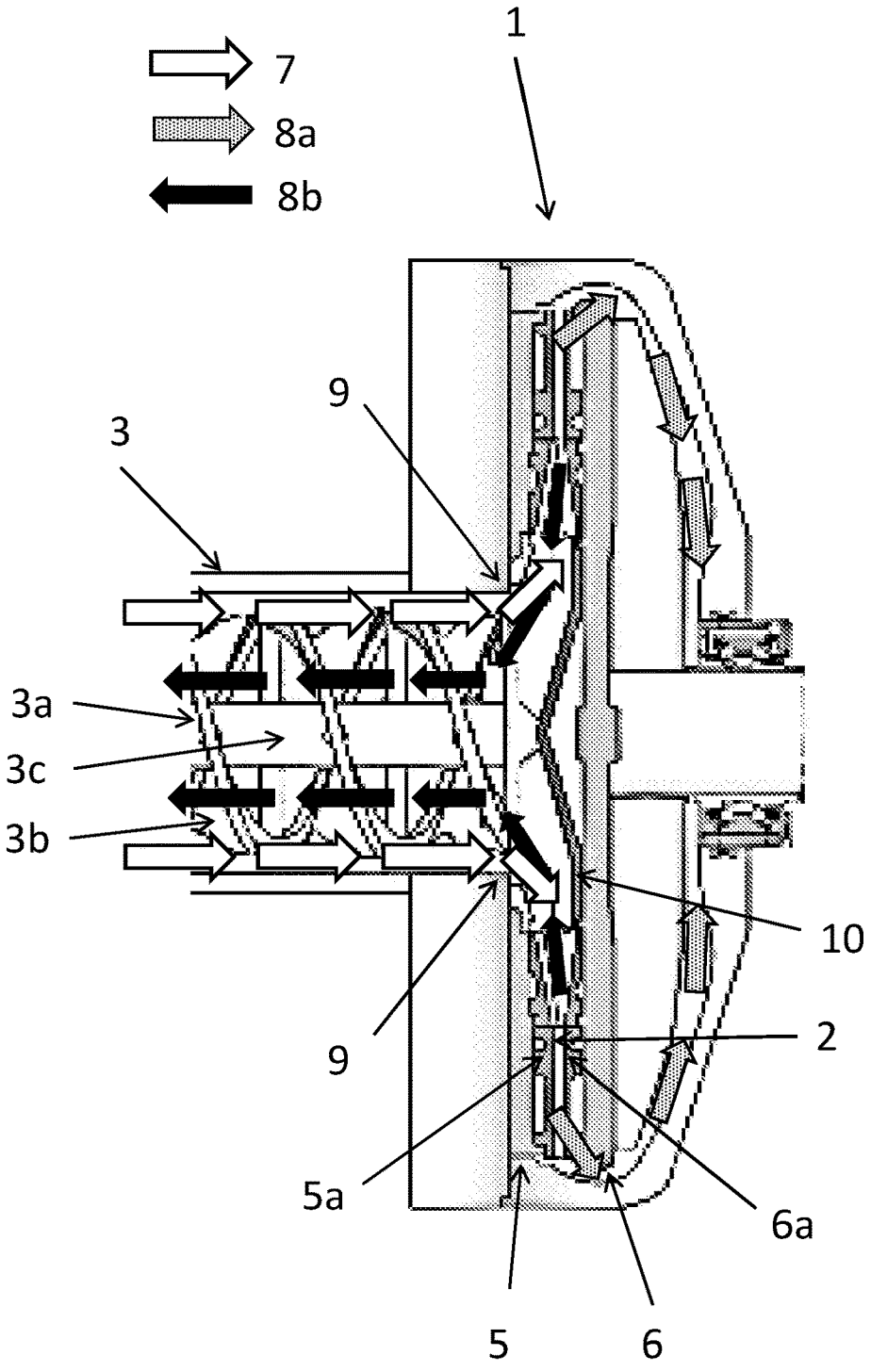
FIG. 1 is a schematic illustration of an embodiment of a typical defibrator in a refiner.

FIG. 1 is a schematic illustration of a typical defibrator arrangement in a pulp or fiber refiner. Here, a defibrator with a rotor and a stator arrangement is described, but the present embodiments may also be applied in a defibrator with two rotors. Lignocellulose-containing material 7, such as wood chips, is fed by a conveyor screw/feed screw 3*a*, usually a ribbon feeder, via a feeding channel 3 towards the defibrator 1 and through a hole in the stator 5 into a central space between the refining discs, i.e. the stator 5 and the rotor 6. The centrifugal force pushes the material towards the circumference of the refining discs to emerge in the refining gap/space 2 between the refining surfaces of the refining segments of the refining discs. When the lignocellulose-containing material is refined in the refining gap/space 2 between the refining segments 5*a*, 6*a* of the stator 5 and the rotor 6, some of the moisture in the chips/fiber is turned into steam. The steam flow is usually very irregular, but some steam 8*a* will flow forwards in the same direction as the material 7, and some of the steam 8*b* will also flow backwards towards the center of the refining discs. The steam flow will depend—among other things—on how the refining segments are designed. To facilitate evacuation of steam from the defibrator, the feed screw 3*a* is usually a ribbon feeder which has a center cavity 3*b*, surrounding the center axis 3*c*, for allowing steam to flow backwards from the defibrator 1 and escape through the feed screw 3*a*, as illustrated in FIG. 1. Experience shows that the flow of fibrous material is following acceleration (rotation/centrifugal forces) since the material has weight. Therefore, the fibrous material ends up primarily in the periphery of the ribbon feeder and is fed forwards, whereas back-streaming steam 8*b* with less or almost no weight is travelling backwards primarily in the center cavity 3*b* of the ribbon feeder.

However, in order to escape through the feed screw the steam formed between the rotor and the stator first has to find its way back towards the center of the rotor and stator, working against the flow of material being fed in the opposite direction, as illustrated in FIG. 1. Lignocellulose-containing material 7 is fed by the feed screw 3*a* into the central space between the stator 5 and rotor 6, and is then directed by the centrifugal forces into the refining gap/space 2 and further towards the periphery of the stator 5 and rotor 6, where the refined fibers 7*b* are ejected from the defibrator. The refining surfaces of the stator 5 and/or rotor 6 typically comprise a number of different refining segments 5*a*, 6*a* having refining bars of different sizes and orientations, for improving the grinding action on the fibers. The rotor 6 may also be provided with a center plate 10, which is located at the rotational center of the rotor 6, on the side of the rotor 6 facing the stator 5. The purpose of the center plate 10 is to help feeding the fibrous material 7 towards the periphery of the rotor 6 and stator 5. The surface of a center plate is typically provided with a set of feeding bars or "wings" or wing profiles, whose purpose is to direct the fibrous material more evenly towards the rim/periphery of the stator-rotor arrangement.

As described above, some of the steam developed in the refining space will flow backwards towards the center of the defibrator, and this back-streaming steam 8*b* must then work its way through the flow of material 7 on its way to the center of the ribbon feeder, thus causing a feed conflict 9 which results in turbulence and losses. This feed conflict results in unnecessary restriction of the steam flow which causes higher energy consumption, feed variations of the material flow which causes lower fiber quality as well as higher energy consumption.

Therefore, the aim of the present invention is to provide a way for steam to be evacuated from the refining space in order to avoid the feed conflict between the material flow and the back-streaming steam.

Figure 2:
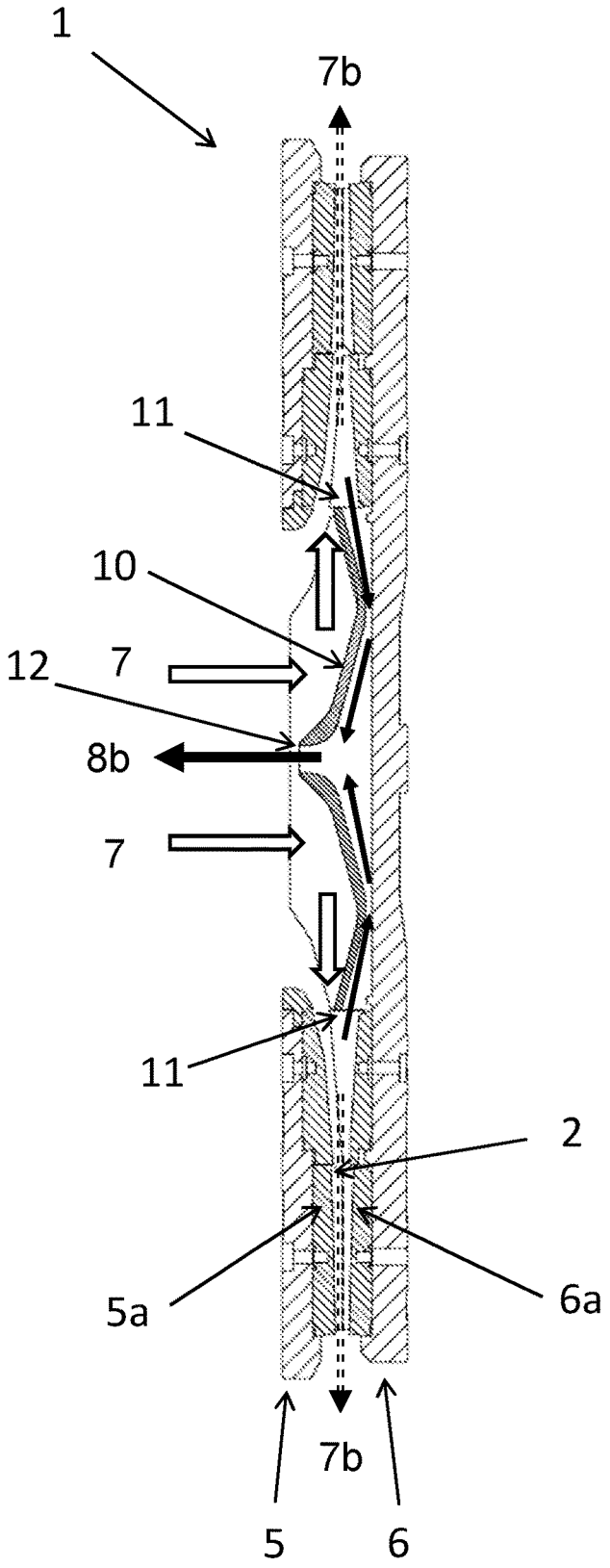
FIG. 2 is a schematic illustration of a defibrator according to an embodiment of the present disclosure.

FIG. 2 is a schematic illustration of a defibrator 1 for refining fibrous material according to an embodiment of the present disclosure. In this embodiment steam produced in the refining space 2 is evacuated through one or more non-central openings/slots 11 in one of the refining discs, e.g. the rotor 6, to the backside of the refining disc, i.e. the side of the disc facing away from the refining space 2. By guiding the steam to the backside of the refining disc, the steam is prevented from passing through the flow of fibrous material which occurs on the front side. The steam can then flow on the backside towards the center of the refining disc and through a central hole 12 in the rotational center of the refining disc, and escape from the defibrator through the feed screw/ribbon feeder, again without passing through the material flow. Thus, the present disclosure allows back-streaming steam to be evacuated from the defibrator without disturbing the flow fibrous material, and the above-described feed conflict can be avoided.

Thus, according to the embodiment illustrated in FIG. 2 a refining disc 6 in a defibrator 1 is provided with at least one non-central opening/slot 11 extending from the front side of the refining disc, i.e. the side facing the refining space 2, to the backside of the refining disc, i.e. the side facing away from the refining space 2, for allowing steam developed in the refining space 2 to flow through the at least one opening 11 from the front side to the backside of the refining disc. The refining disc 6 is also provided with a central hole 12 located in the rotational center of the refining disc 6 and extending from the backside to the front side of the refining disc 6, for allowing steam 8*b* to flow through the central hole 12 from the backside to the front side at the center of the refining disc 6 and then escape from the defibrator 1.

In a preferred embodiment, the at least one non-central opening 11 is formed as a channel directed towards the center of the refining disc 6, so that the steam is guided towards the center of the refining disc. The inlet of the opening 11 may also in an embodiment extend into the central space between the refining discs in order to "catch" the steam flowing in the central space and draw it into the opening 11, as schematically illustrated in FIG. 2. Thus, the inlet of the opening 11 may in this embodiment be configured to be generally parallel with the direction of the steam flow.

The refining disc may in an embodiment be a rotor in a defibrator.

In some embodiments the refining disc may be provided with a center plate 10, and in such a case the opening/slot 11 may be provided between the refining segments 6*a* of the refining disc 6 and the center plate 10.

Figure 3:
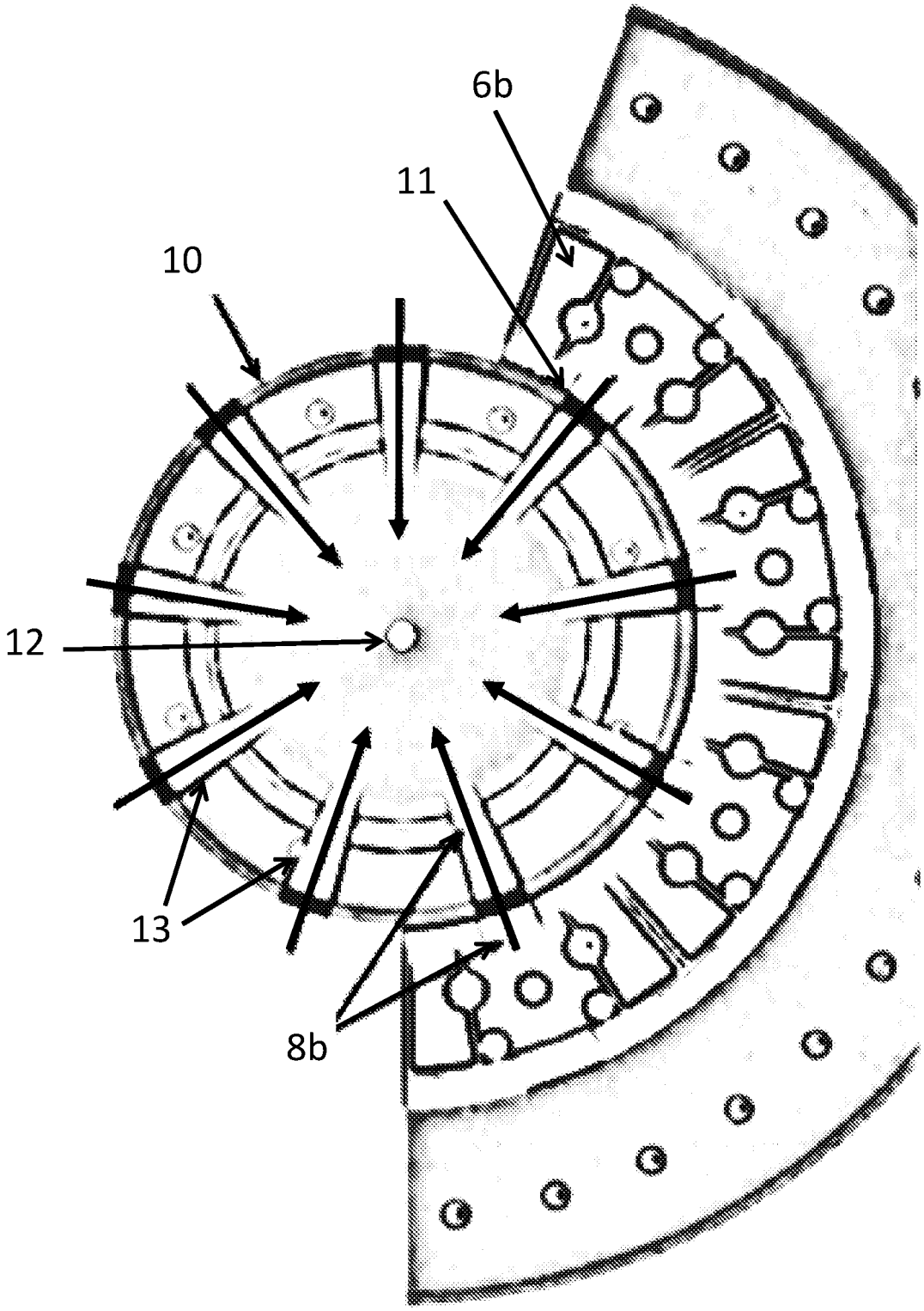
FIG. 3 is a schematic illustration of a center plate in a defibrator according to an embodiment of the present disclosure.

FIG. 3 is a schematic illustration of a center plate 10 for a refining disc 6 in a defibrator according to a particular embodiment, where the center plate 10 is provided with one or more channels 13 on its backside to guide the steam towards the central hole 12 in the center plate 10. Each channel 13 may in an embodiment extend from a respective opening 11 and is preferably arranged in a substantially radial direction to guide the steam towards the central hole 12. The channels 13 may in an embodiment extend all the way to the central hole 12 or in another embodiment they may have inner ends located at a distance from the central hole 12. The channels 13 may in an embodiment be symmetrically distributed in the angular direction around the refining disc 6. The channels 13 may be straight or curved in different embodiments.

Figure 4:
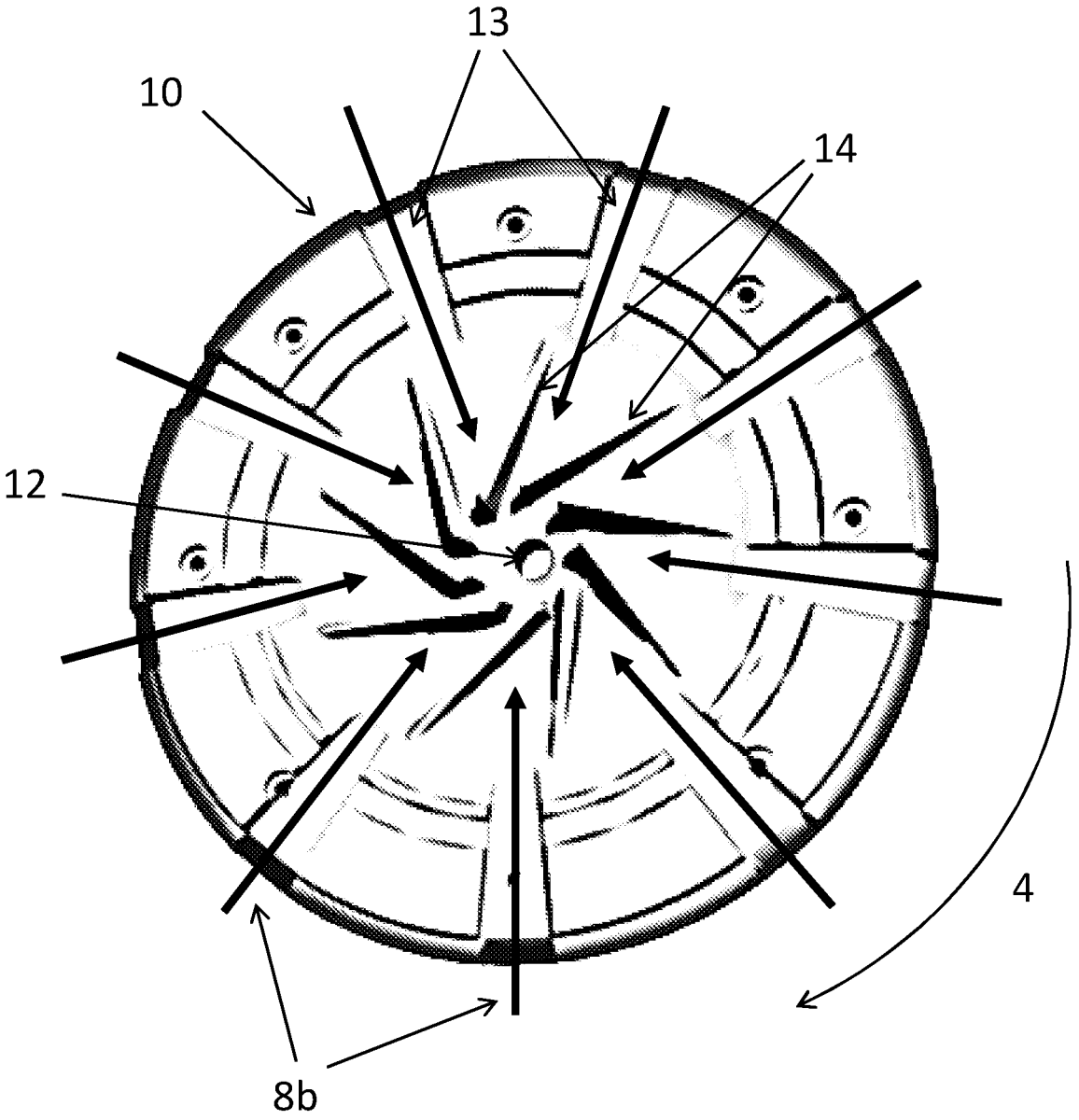
FIG. 4 is a schematic illustration of a center plate in a defibrator according to another embodiment of the present disclosure.

As illustrated in FIG. 4, the backside of the center plate 10 may also be provided with one or more elongated protrusions or wings 14 in an embodiment, to guide the steam towards the central hole 12 and further improve the evacuation/ejection of steam through the central hole 12 and out of the defibrator. Each wing 14 has an inner end and an outer end, where the inner end is arranged closer to the center of the refining disc 6 than the outer end. In some embodiments the outer ends of the wings 14 may be arranged adjacent to the inner ends of the channels 13, or closer to the center of the refining disc 6 than the inner ends of the channels 13. The inner ends of the wings 14 may in an embodiment be arranged adjacent to the edge of the central hole 12, or displaced from the central hole in a radial direction. The wings 14 may in some embodiments be arranged in a substantially radial direction, or angled such that the inner ends of the wings 14 are displaced in an angular direction which is opposite to the rotational direction 4 of the refining disc 6, as compared to a radius of the refining disc 6. The wings 14 may in an embodiment be symmetrically distributed in the angular direction around the refining disc 6. Each wing 14 may in an embodiment be arranged adjacent to a respective channel 13, at a trailing edge of the channel 13 with respect to the rotational direction 4 of the refining disc 6. The wings may be straight or curved in different embodiments.

All embodiments of the present disclosure can be fitted to a defibrator arrangement of well-known pulp/fiber refiners, for example refiners with a rotor-stator arrangement as described above, as well as refiners with two rotors instead of a rotor-stator arrangement, i.e. two rotors that can be rotated independently.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A first refining disc in a defibrator for refining fibrous material in which steam is generated, the first refining disc comprising a first refining surface, including refining bars and grooves facing a second refining surface of a second refining disc, the refining surfaces defining a refining space between said first refining surface and said second refining surface for refining the fibrous material, wherein the first refining disc is provided with at least one non-central opening extending from a front side of the first refining disc to a backside of the first refining disc, where the front side faces the second refining disc and the backside faces away from the second refining disc, the first refining disc further comprising a center plate located at the rotational center of the first refining disc on a side of the first refining disc adapted to face the second refining disc, wherein the at least one non-central opening is provided between a refining segment of the first refining disc and the center plate, for allowing steam developed in the refining space during refining to flow through the at least one non-central opening from the front side to the backside of the first refining disc, and a central hole located in a rotational center of the first refining disc and extending from the backside to the front side of the first refining disc, wherein the backside of the center plate is provided with channels for guiding the steam towards the center hole of the first refining disc, the backside of the center plate being adapted to face away from the second refining disc for allowing steam to flow inwardly along said backside of said first refining disc towards said central hole and through the central hole from the backside to the front side of the first refining disc at the rotational center of the first refining disc.

2. The first refining disc according to claim 1, wherein a backside of the center plate is provided with wings for guiding the steam towards the central hole of the first refining disc, the backside of the center plate being adapted to face away from the second refining disc.

3. The first refining disc according to claim 1 wherein the first refining disc is a rotor in a defibrator.

4. A defibrator for refining fibrous material comprising a first refining disc according to claim 1.

* * * * *